US012196083B2

(12) United States Patent
Burger et al.

(10) Patent No.: US 12,196,083 B2
(45) Date of Patent: Jan. 14, 2025

(54) TUNNEL BORING MACHINE

(71) Applicant: HERRENKNECHT AKTIENGESELLSCHAFT, Schwanau (DE)

(72) Inventors: Werner Burger, Schwanau (DE); Gerhard Wehrmeyer, Schwanau (DE)

(73) Assignee: HERRENKNECHT AKTIENGESELLSCHAFT, Schwanau (DE)

( * ) Notice: Subject to any disclaimer, the term of this patent is extended or adjusted under 35 U.S.C. 154(b) by 207 days.

(21) Appl. No.: 17/911,685

(22) PCT Filed: Apr. 13, 2021

(86) PCT No.: PCT/EP2021/059587
§ 371 (c)(1),
(2) Date: Sep. 15, 2022

(87) PCT Pub. No.: WO2021/219369
PCT Pub. Date: Nov. 4, 2021

(65) Prior Publication Data

US 2023/0135570 A1 May 4, 2023

(30) Foreign Application Priority Data

Apr. 28, 2020 (DE) ..... 10 2020 111 585.7

(51) Int. Cl.
*E21D 9/00* (2006.01)

(52) U.S. Cl.
CPC ..... *E21D 9/003* (2013.01)

(58) Field of Classification Search
CPC ..... E21D 9/003; E21D 9/093
See application file for complete search history.

(56) References Cited

U.S. PATENT DOCUMENTS

| | | | | |
|---|---|---|---|---|
| 4,152,027 A | | 5/1979 | Fujimoto et al. | |
| 4,167,290 A | * | 9/1979 | Yamazaki | E21F 17/00 299/30 |
| 4,774,470 A | * | 9/1988 | Takigawa | E21D 9/003 175/50 |
| 11,277,675 B2 | * | 3/2022 | Huang | H04Q 9/00 |

FOREIGN PATENT DOCUMENTS

| | | | |
|---|---|---|---|
| CN | 106437731 | * | 2/2017 |
| CN | 106437731 A | | 2/2017 |
| CN | 107607082 A | | 1/2018 |
| CN | 207879337 U | | 9/2018 |

* cited by examiner

*Primary Examiner* — Carib A Oquendo
(74) *Attorney, Agent, or Firm* — Tarolli, Sundheim, Covell & Tummino LLP

(57) ABSTRACT

In a tunnel boring machine with a shield skin (106) extending in a longitudinal direction, a sensor unit (118) for detecting convergences has a number of hydraulic distance sensors (121) equipped with an extendable probe (124) with extension path measurement. By virtue of the distance sensors (121), the distance between the shield skin (106) in the area of the relevant distance sensor (121) and the surrounding rock mass (103) can be detected as a distance value, so that the thickness of an annular gap (115) can be determined. The distance sensors (121) are arranged in the longitudinal direction of the shield skin (106) at a measuring distance which corresponds to a typical ring width of a tubbing (112). A central unit evaluates the distance values of the distance sensors (121) to determine convergences.

12 Claims, 4 Drawing Sheets

TUNNEL BORING MACHINE

RELATED APPLICATIONS

Figure 1:
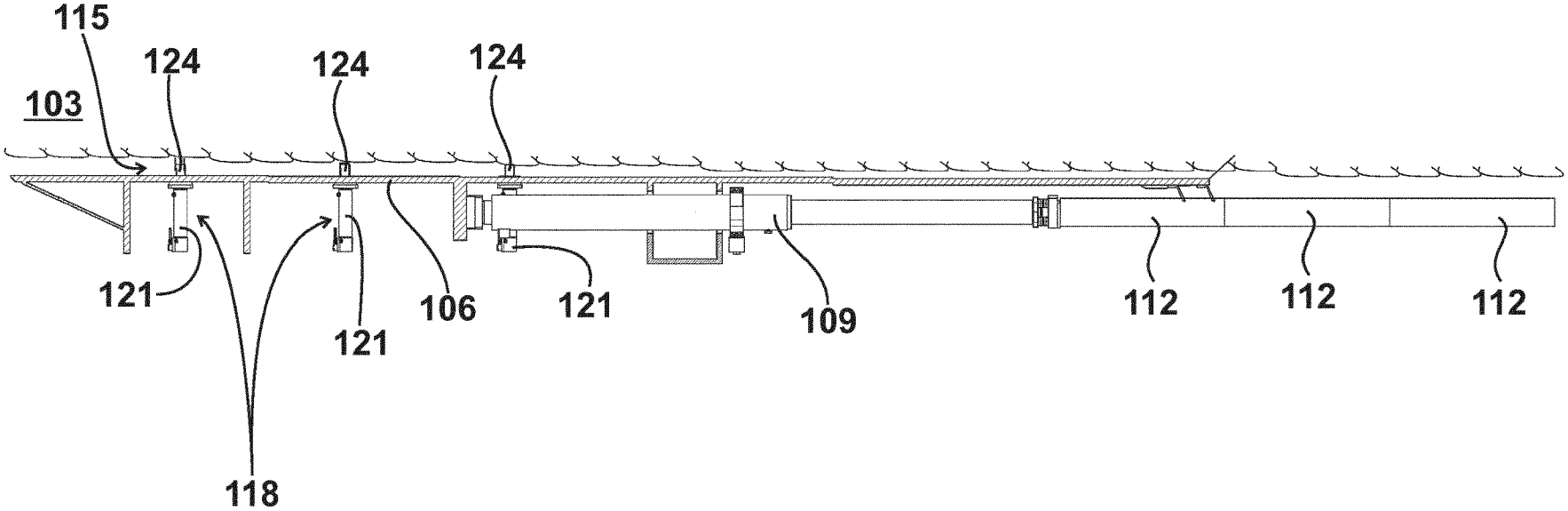

This application filed under 35 U.S.C § 371 is a national phase application of International Application Number PCT/EP2021/059587, filed Apr. 13, 2021, which claims the benefit of German Application No. 10 2020 111 585.7 filed Apr. 28, 2020, the subject matter of which are incorporated herein by reference in their entirety.

The invention relates to a tunnel boring machine according to the preamble of claim 1.

Such a tunnel boring machine is known from CN 107 607 082 A. This previously known tunnel boring machine has a shield skin extending in a longitudinal direction and a sensor unit equipped with distance sensors for detecting convergences. To carry out a continuous measurement method, the distance sensors work with a continuous spring force and are in constant contact with the surrounding rock mass during the excavation.

Another tunnel boring machine is known from the technical article by D. Harding entitled "Difficult Ground Solutions (DGS): Mew TBM Solutions carve a Path to Success", published in Proceedings of the World Tunnel Congress 2017—Surface challenges—Underground solutions, Bergen, Norway. In this previously known tunnel boring machine, which has a shield skin extending in a longitudinal direction, a sensor unit is provided in the form of a hydraulic cylinder, which is installed on the shield skin near the cutting wheel in the ridge area, with this hydraulic cylinder, the thickness of the annular gap at the tunnel crown can be measured in order to record convergences.

A tunnel boring machine with a shield skin extending in a longitudinal direction and with a sensor unit having a number of laser rangefinders, which are attached to the inside of the shield skin in the longitudinal and circumferential direction, is known from CN 207379337 U.

The object of the invention is to specify a tunnel boring machine of the type mentioned at the outset, which is distinguished by reliable measurement of an annular gap present between the shield skin and the rock mass.

In a tunnel boring machine of the type mentioned at the outset, according to the invention this object is achieved with the characterizing features of claim 1.

Due to the discontinuous work created in the present invention during breaks in excavation and the recording of distance values at measuring distances determined by tubbings to be installed, on the one hand the location accuracy in the position of the distance sensors is very reliably and easily ensured in terms of measurement technique and it is also guaranteed that the distance sensors will not be damaged in the extremely rough environment during phases of excavation. In addition, it has been found that by advancing the probes into the annular gap in the radial direction, larger moving components such as pieces of rock can also be displaced, resulting in a relatively high measurement accuracy.

Due to the fact that the sensor unit in the tunnel boring machine according to the invention has at least two, expediently more than two hydraulic distance sensors with an extendable probe with extension path measurement and arranged in the longitudinal direction at at least one measuring distance and expediently also in the circumferential direction if there are more than two distance sensors, it is possible to determine and evaluate by the central unit convergences in the area of the shield skin in changing distance values as the excavation progresses.

Further expedient embodiments of the invention are the subject matter of the dependent claims.

Further expedient embodiments and advantages of the invention result from the following description of exemplary embodiments with reference to the figures of the drawing.

Figure 2:
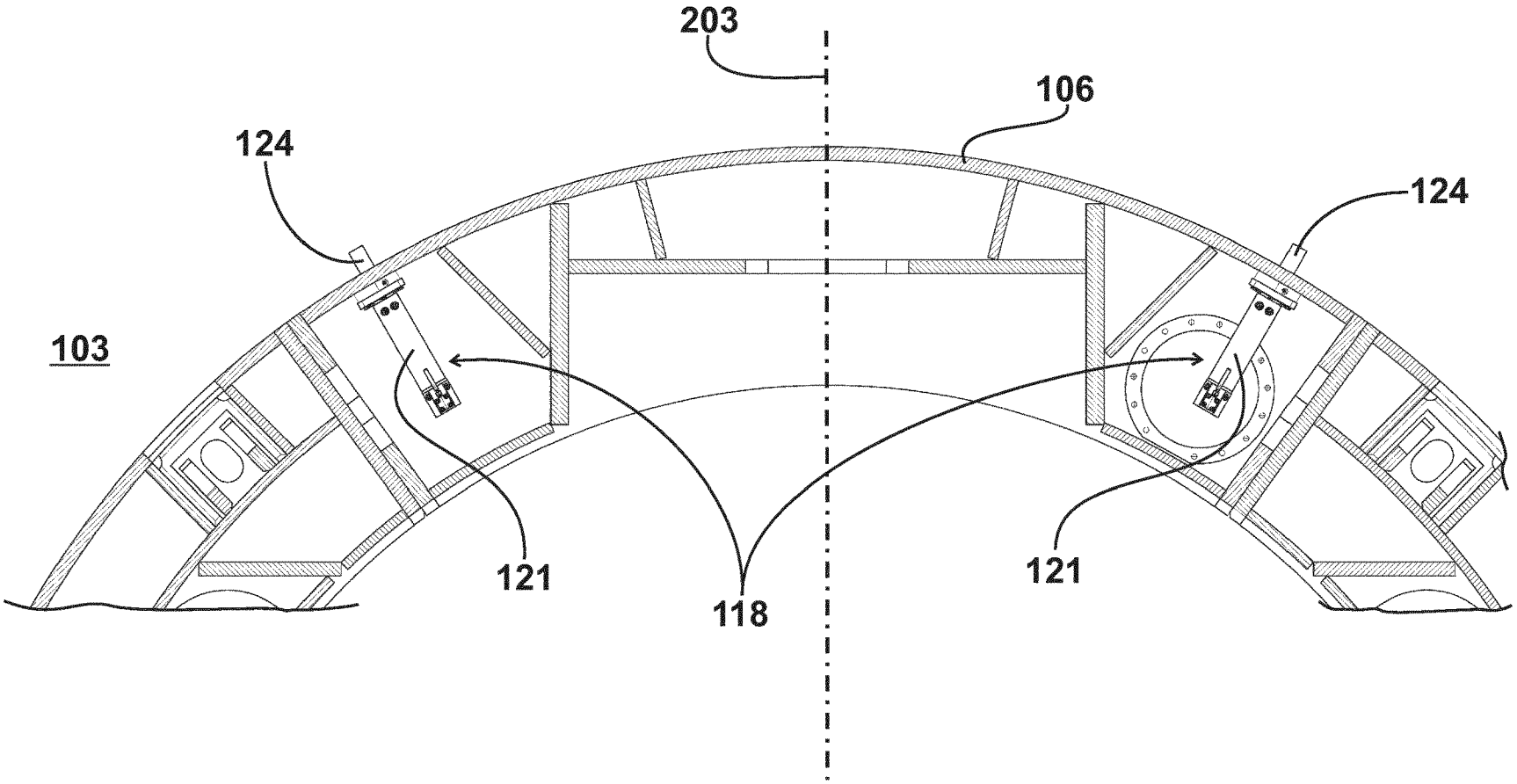
Figure 3:
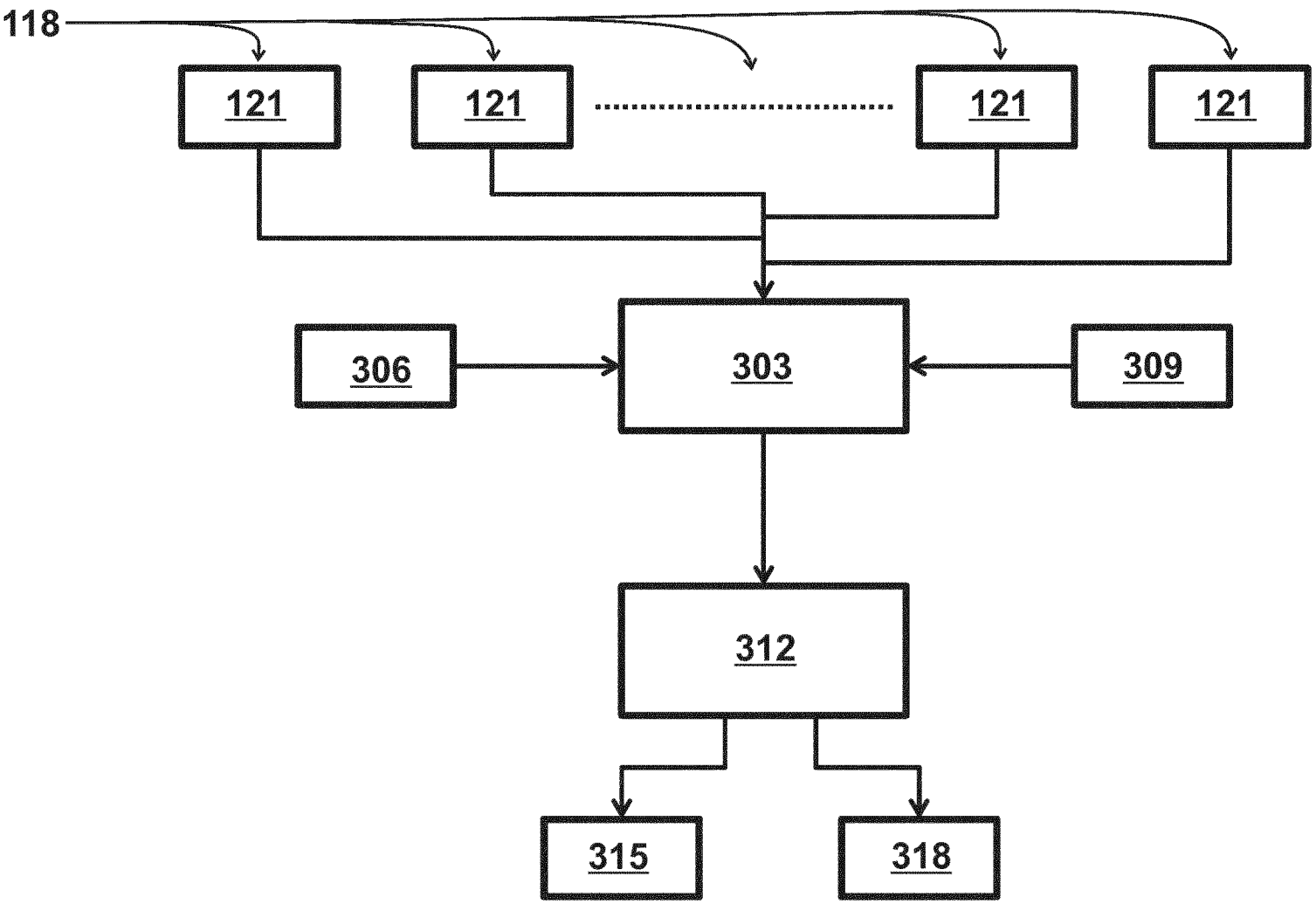

In the figures:

FIG. 1 shows a side view of an exemplary embodiment of a shield shin of a tunnel boring machine with a sensor unit which has a number of distance sensors in a longitudinal direction, FIG. 2 shows a sectional view through a shield skin of a tunnel boring machine of an exemplary embodiment of the invention in the ridge area, FIG. 3 shows a block diagram of an exemplary configuration of a sensor unit and a central unit with further components in an exemplary embodiment of a tunnel boring machine according to the invention, and FIGS. 4 to 7 show sectional views of another exemplary embodiment of a tunnel boring machine according to the invention in the area of a shield skin in various stages of an excavation.

FIG. 1 shows a sectional side view of an exemplary embodiment of a tunnel boring machine in the area of a shield skin 106 for boring a tunnel into a rock mass 103. A number of feeding jacks 109 are attached to the shield skin 106, which act in a longitudinal direction of the shield skin 106 and are supported on tubbings 112 of a ring construction for lining a tunnel during the excavation. On the front side of the tunnel boring machine opposite the tubbings 112 in the direction of excavation, there is a cutting wheel not shown in FIG. 1, by virtue of which a tunnel cavity can be created in the rock mass 103.

The tunnel cavity created by the mining action of the cutting wheel has a diameter which is larger than the diameter of the shield skin 106, so that an annular gap 115 is formed between the rock mass 103 and the outside of the shield skin 106. The annular gap 115 is usually at least partially filled with liquid and solid, granular components from the mining operation. However, as shown in FIG. 1, convergences of the rock mass 103 usually lead to the annular gap 115 narrowing in the longitudinal direction of the shield skin 106 pointing away from the cutting wheel in the direction of the tubbings 112. Therefore, if the convergence is too pronounced and the rock mass 103 comes into contact with the shield skin 106, there is a risk that the tunnel boring machine will be jammed.

To detect convergence of the rock mass 103 via changes in the dimensions of the annular gap 115, the exemplary embodiment of FIG. 1 includes a sensor unit 118, which has a number of hydraulic distance sensors 121, which are arranged in the longitudinal direction of the shield skin 106 at a measuring distance and preferably also along the circumference of the shield skin 106 at regular intervals. Each distance sensor 121 has a probe 124, which can be advanced in the radial direction into the annular gap 115 and is set up as a distance value as part of an extension path measurement to measure the distance between the shield skin 106 in the area of the relevant distance sensor 121 and the rock mass 103.

FIG. 2 shows a cross section of the shield skin 106 in the ridge area in the exemplary embodiment according to FIG. 1. It is evident from FIG. 2 that the sensor unit 118 also has distance sensors 121 arranged along the circumference of the shield skin 106 in addition to distance sensors 121 arranged at a measuring distance in the longitudinal direction of the shield skin 106. In the arrangement according to FIG. 2, the distance sensors 121 arranged along the circumference of the shield skin 106 are positioned essentially symmetrically to a central vertical axis 203. The angle of the distance sensors 121 to the central vertical axis 203 is expediently between approximately 15 degrees and approximately 45 degrees, preferably in the range of approximately 30 degrees. In a development that is not shown, it is provided that distance sensors 121 are also arranged in the middle of the ridge area on the middle vertical axis 203.

FIG. 3 shows a block diagram of the sensor unit 118 with the distance sensors 121 which are connected to a measurement data memory 303 for storing the distance values obtained via the distance sensors 121. A timer 306 and a position sensor 309 are also connected to the measurement data memory 303. Time data can be generated with the timer 306, which can be linked in the measurement data memory 303 with the distance values obtained at the relevant time. The position sensor 309 can be used to generate position data of the shield skin 106, which can also be linked to the distance values obtained at specific positions of the shield skin 106.

In this way, the distance values of the various distance sensors 121 are available in a time profile and in a location profile.

The measurement data memory 303 is connected to a central unit 332, by virtue of which the distance values with the linked time data and position data can be evaluated so that convergences of the rock mass 103 can be evaluated in particular so that it can be determined whether certain minimum distance values between the rock mass 103 and the shield skin 106 are maintained. The central unit 312 can furthermore generate a forecast of the convergences to foe expected, particularly in the area facing away from the cutting wheel and adjacent to the tubbings 112, based on the distance values resolved in terms of time and location, in order to ensure as far as possible that there is no risk of the tunnel boring machine getting stuck.

A signal generator 315 and a display 318 are expediently connected to the central unit 312. The signal generator 315 is set up to emit a warning, for example in the form of a signal tone or a visual warning signal, when critical distance values are reached between the rock mass 103 and the shield skin 106. The display 318, in turn, is set up to graphically display the temporal and spatial progression of the distance values recorded by the distance sensors 121 and of predicted distance values.

The central unit 312 further has excavation data representing the trajectory of the tunnel boring machine, which can be taken into account when evaluating the convergences with regard to critical values such that an annular gap 115 that decreases in a controlled manner due to a curved trajectory does not lead to false alarms.

FIGS. 4 to 7 show a sectional side view in accordance with FIG. 1 of a further exemplary embodiment of a tunnel boring machine in the area of a shield skin 106 in various phases of the excavation.

Figure 4:
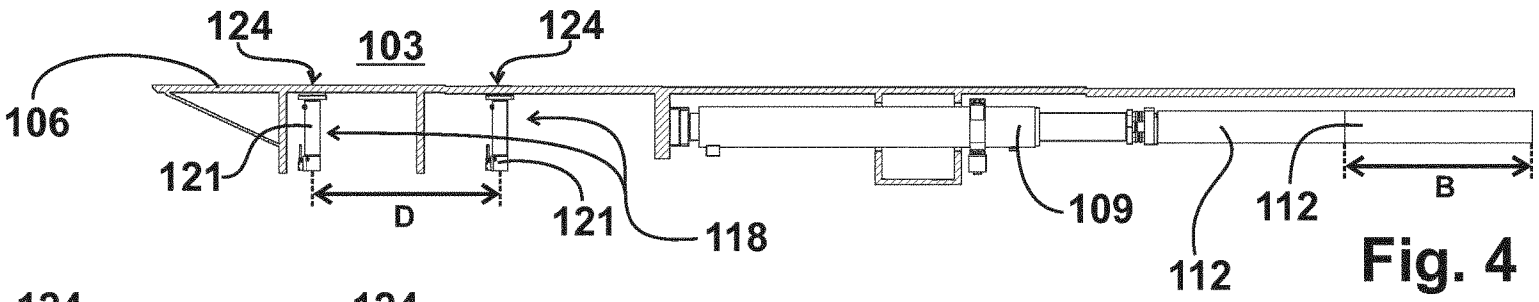

FIG. 4 shows the arrangement in accordance with FIG. 1 after completion of a ring of tubbings 112 with a ring width B with retracted feeding jacks 109 and retracted probes 124 of in this case two distance sensors 121 in the longitudinal direction. The distance sensors 121 are arranged at a measuring distance D. Starting with the arrangement according to FIG. 4, an excavation cycle begins, which will be completed with the installation of a next ring of tubbings 112.

Figure 5:
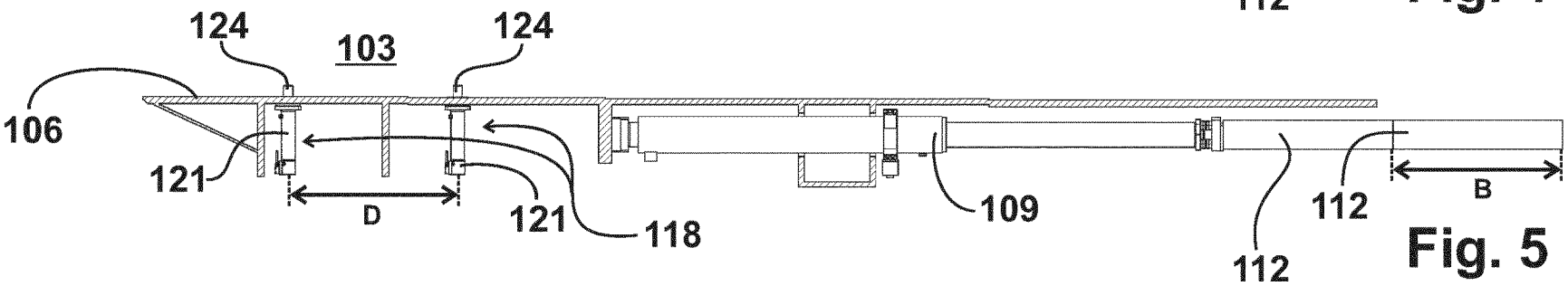

FIG. 5 shows the arrangement according to FIG. 4 with fully extended feeding jacks 109 shortly before installing tubbings 112. The excavation is interrupted in this phase, so that the probes 124 of the distance sensors 121 are extended and in contact with the rock mass 103, as shown in FIG. 5, displacing pieces of rock if necessary. The distance values obtained at this point in time and at this position of the shield skin 106 can be fed into the measurement data memory 303.

Figure 6:
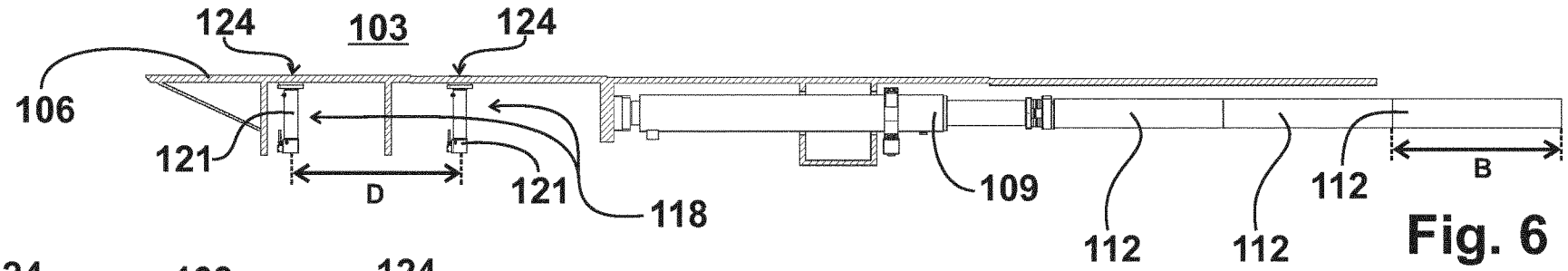

FIG. 6 shows the next phase of the excavation, beginning after the installation of the next ring of tubbings 112, in which the probes 124 of the distance sensors 121 are retracted again and remain retracted until the end of this phase of the excavation.

Figure 7:
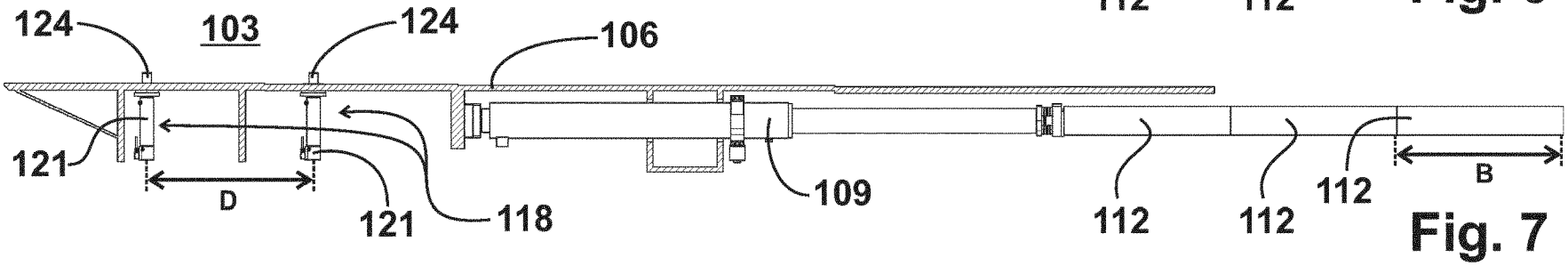

FIG. 7 shows in accordance with FIG. 5 the feeding jacks 109 once again in the maximum extended position with the probes 124 of the distance sensors 121 extended again to obtain distance values.

The sequence of FIGS. 4 to 7 also clearly shows that in this exemplary embodiment, the measuring distance D between the two distance sensors 121 in this case corresponds to the ring width B of the tubbings 112. This ensures that each measuring point on the rock mass 103 is detected twice, or multiple times if more than two distance sensors 121 are provided, each at a corresponding measuring distance D, in terms of its distance from the shield skin 106. As a result, the convergences can be determined very precisely and, moreover, reliable forecasts can be made for the rear area of the shield skin 106 in the direction of excavation.

The invention claimed is:

1. A tunnel boring machine comprising:

a shield skin (106) extending in a longitudinal direction;

tubbings (112) each having a ring width (B) in the longitudinal direction and extending upstream of the shield skin (106) for lining a tunnel as the boring machine advances therein;

a sensor unit (118) having at least two hydraulic distance sensors (121) for detecting convergences with an extendable probe (124) with extension path measurement, by virtue of which a distance between the shield skin (106) in the area of the relevant distance sensor (121) and a surrounding rock mass (103) can be detected as a distance value, in that the distance sensors (121) in the longitudinal direction of the shield skin (106) are arranged at a measuring distance (D), the measuring distance (D) of the distance sensors (121) in the longitudinal direction of the shield skin (106) corresponding to the ring width (B) of the tubbing (112), in that the probes (124) are extendable during interrupted excavation and retracted during excavation; and a central unit (312) for evaluating the distance values of the distances sensors (121) to determine the convergences.

2. The tunnel boring machine of claim 1, wherein there is a position sensor (309) by which the position of the shield skin (106) can be determined, in order to evaluate the distance values for specific positions of the distance sensors (121) in the longitudinal direction.

3. The tunnel boring machine of claim 1, wherein there are at least three distance sensors (121) in the longitudinal direction of the shield skin (106).

4. The tunnel boring machine of claim 1, wherein there are at least two distance sensors (121) along the circumference of the shield skin (106).

5. The tunnel boring machine of claim 4, wherein the distance sensors (121) arranged along the circumference of the shield skin (106) are arranged symmetrically to a central vertical axis (203).

6. The tunnel boring machine of claim 1, wherein there is a timer (306) by virtue of which the times when distance values are recorded can be determined, in order to evaluate the distance values at specific times.

7. The tunnel boring machine of claim 1, wherein there is a signal generator (315) connected to the central unit (312), by virtue of which a warning signal can be output in the event of critical convergences.

8. The tunnel boring machine of claim 1, wherein there is a display (318) connected with the central unit (312), by virtue of which the temporal and/or path-related course of the distance values can be displayed graphically.

9. The tunnel boring machine of claim 1, wherein the shield skin (106) has a unitary construction and the tubbings (112) are formed as segments connected end-to-end in the longitudinal direction with at least one of the tubbings (112) extending into the shield skin (106).

10. The tunnel boring machine of claim 1, wherein all the hydraulic distance sensors (121) are extendable through the shield skin (106).

11. The tunnel boring machine of claim 1, wherein the hydraulic distance sensors (121) have respective fixed longitudinal positions along the shield skin (106).

12. A tunnel boring machine comprising:

a shield skin (106) extending in a longitudinal direction;

segmented tubbings (112) each having a ring width (B) in the longitudinal direction and collectively extending upstream of the shield skin (106) for lining a tunnel as the boring machine advances therein;

a sensor unit (118) including at least two hydraulic distance sensors (121), each distance sensor (121) having a probe (124) extendable during interrupted excavation and retracted during excavation for measuring a distance between the shield skin (106) in the area of the relevant distance sensor (121) and a surrounding rock mass (103), wherein the distance sensors (121) are spaced from one another in the longitudinal direction at a measuring distance (D) corresponding to the ring width (B) of the tubbing (112); and a central unit (312) for evaluating the distances measured by the distance sensors (121) to determine convergences between the shield skin (106) and the rock mass.

* * * * *